US012195984B2

(12) United States Patent
Naos et al.

(10) Patent No.: US 12,195,984 B2
(45) Date of Patent: Jan. 14, 2025

(54) BRACKET AND METHOD FOR FASTENING MEMBRANE TO A ROOF

(71) Applicant: STRUCTURAL WRAP, LLC, Miami, FL (US)

(72) Inventors: Spiro Naos, Miami, FL (US); Larry Bond, Miami, FL (US); Christopher Mouriz, Miami, FL (US)

( * ) Notice: Subject to any disclaimer, the term of this patent is extended or adjusted under 35 U.S.C. 154(b) by 104 days.

(21) Appl. No.: 17/897,937

(22) Filed: Aug. 29, 2022

(65) Prior Publication Data

US 2023/0399861 A1 Dec. 14, 2023

Related U.S. Application Data

(63) Continuation-in-part of application No. 29/842,386, filed on Jun. 13, 2022, now Pat. No. Des. 1,015,857.

(51) Int. Cl.
*E04G 21/24* (2006.01)

(52) U.S. Cl.
CPC ..... *E04G 21/24* (2013.01)

(58) Field of Classification Search
CPC .. E04G 21/24; A47G 1/20; A47G 1/22; F16B 15/0023; F16B 15/0046; F16B 15/0053
USPC ..... 248/226.11, 227.1, 227.2, 227.4, 228.1, 248/228.6, 231.71, 231.81, 231.85, 300, 248/301, 316.1, 316.8
See application file for complete search history.

(56) References Cited

U.S. PATENT DOCUMENTS 2,283,167 A * 5/1942 Burson ..... E04F 13/045 411/921
5,152,117 A * 10/1992 Wynar ..... E04B 2/7457 52/712
8,672,600 B2 * 3/2014 Reznar ..... E04F 15/04 52/489.1
10,092,103 B2 * 10/2018 Bright ..... A47B 96/02

* cited by examiner

*Primary Examiner* — Alfred J Wujciak
(74) *Attorney, Agent, or Firm* — Sanchelima & Associates, P.A.; Jesus Sanchelima; Christian Sanchelima

(57) ABSTRACT

A system and method for fastening an impermeable membrane to includes a bracket having a horizontal planar element, a central planar element extending upwards from the horizontal plan element, a lip extending upwards from the horizontal plan element, the lip comprising a planar element with a height shorter than a height of the central planar element, a gap defined by the central planar element on one side and the lip on another side, the gap configured to accept and secure to a side of a fascia of a structure, arms extending upwards from the horizontal plan element, fasteners protruding from each of the arms and, a gap defined by the central planar element on one side and the arms on another side, the gap configured to accept and secure to construction material and impermeable membrane.

5 Claims, 8 Drawing Sheets

BRACKET AND METHOD FOR FASTENING MEMBRANE TO A ROOF

CROSS-REFERENCE TO RELATED APPLICATIONS

This application is a continuation-in-part of, and claims priority to, design patent application Ser. No. 29/842,386 filed Jun. 13, 2022 and titled "Bracket for Fastening Roof Cover." The subject matter of application Ser. No. 29/842,386 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to the field of residential and commercial structural maintenance and, more specifically, relates to the field of roof maintenance for residential and commercial structures.

BACKGROUND

Maintenance is the process of ensuring that buildings and structures retain a good appearance and operate at optimum efficiency. Inadequate maintenance can result in decay, degradation and reduced performance and can affect health and threaten the safety of users, occupants, and others in the vicinity. Building structure, and roofs in particular, are regularly subjected to harsh conditions including wind, rain, snow, heat, cold, and storms. Said conditions can cause damage to the roof, as well as the interior of the structure. For these reasons, roofs require regular maintenance to maintain optimum efficiency and continue to accomplish their design goals.

When roofs suffer considerable damage, however, significant construction or refurbishing services may be necessary. This may require an extended period of time to accomplish, as contractors must be found and assigned to the job, permits must be obtained, and money must be allocated and transferred. During this period time, the roof cannot be left unattended, as the roof the contents of the structure may suffer further damage. In these situations, therefore, temporary remedial or protective measures are necessary.

Various approaches to this problem have been proposed. A well-known approach to this problem is to attach a temporary water-impermeable membrane to the exterior of the roof to prevent water from penetrating the roof while it remains damaged, also known as the blue tarp method. These approaches, however, are difficult and time-consuming to implement. The current approaches to the problem of applying a temporary membrane to a damaged roof do not address the issue of properly fitting the membrane to the roof size and shape. The current approaches also do not address the issue of fastening the ends or the perimeter of the membrane to the roof. Improper fitting of the membrane to the size and shape of the roof can result in a membrane that can be removed by intense winds or permit water to enter in between the membrane and the roof. Additionally, improper fastening of the ends, or perimeter of, the membrane, can result in a membrane that is too easily removed and allows water penetration. For these reasons, the current approaches to the problem of applying a temporary membrane to a damaged roof are inadequate.

Additionally, the current approaches to the problem of applying a temporary membrane to a damaged roof, including the blue tarp method, add holes to the top of the roof, which can cause further water leakage into the structure, and only last for up to 90 days. In fact, the Federal Emergency Management Agency, FEMA, even categorizes the blue tarp method as only a 30-day solution. Therefore, the current approaches to the problem of applying a temporary membrane to a damaged roof are temporary at best.

Therefore, a need exists to overcome the problems with the prior art as discussed above, and particularly for a more efficient way of applying temporary remedial or protective measures onto a damaged roof.

SUMMARY

A system and method for temporary protection of a damaged roof is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system and method for fastening an impermeable membrane to a roof is provided that solves the above-described problems. The system and method includes a bracket comprising a horizontal planar element, a central planar element extending upwards from, and being perpendicular to, the horizontal plan element, a lip extending upwards from, and being perpendicular to, the horizontal plan element, the lip comprising a planar element with a height shorter than a height of the central planar element, a first gap defined by the central planar element on one side and the lip on another side, the first gap configured to accept and secure to a side of a fascia of a structure, one or more arms extending upwards from the horizontal plan element, each of the one or more arms comprising a planar element with a height shorter than a height of the central planar element, one or more fasteners protruding from each of the one or more arms and, a second gap defined by the central planar element on one side and the one or more arms on another side, the second gap configured to accept and secure to construction material and impermeable membrane.

In another embodiment, a method for covering at least a portion of a roof with an impermeable membrane, comprises placing a strip of the impermeable membrane over the portion of the roof intended to be covered, cutting a length of the strip to accommodate a size of the portion of the roof intended to be covered, draping an end of the strip over a fascia of eaves of the roof, placing elongated construction material on the end of the strip contacting the fascia of eaves of the roof, attaching the elongated construction material to the fascia of eaves of the roof using a plurality of the brackets described above, and repeating steps a) through e) until the portion of the roof is covered in the impermeable membrane.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1:
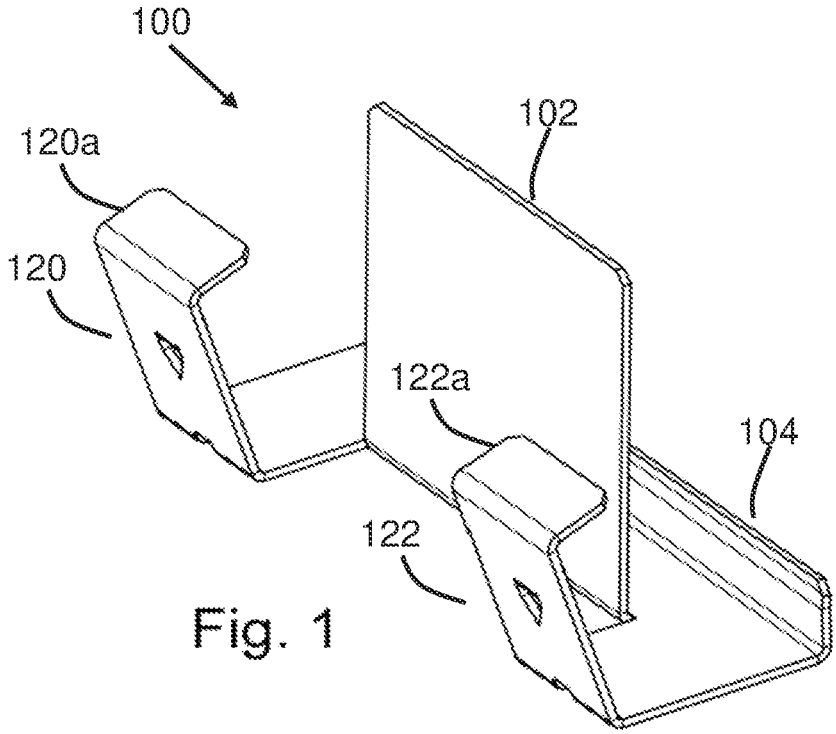
FIG. 1 is a left perspective view of a bracket for fastening a roof cover, according to one embodiment.
Figure 2:
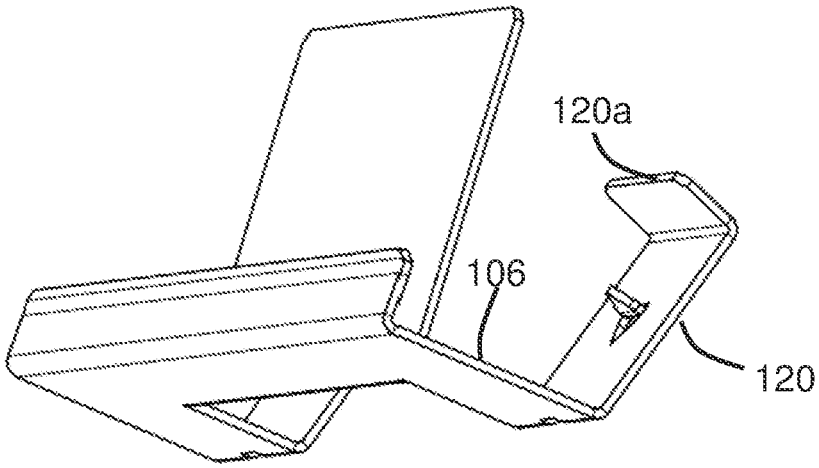
FIG. 2 is a right perspective view of the bracket for fastening the roof cover, according to one embodiment.
Figure 3:
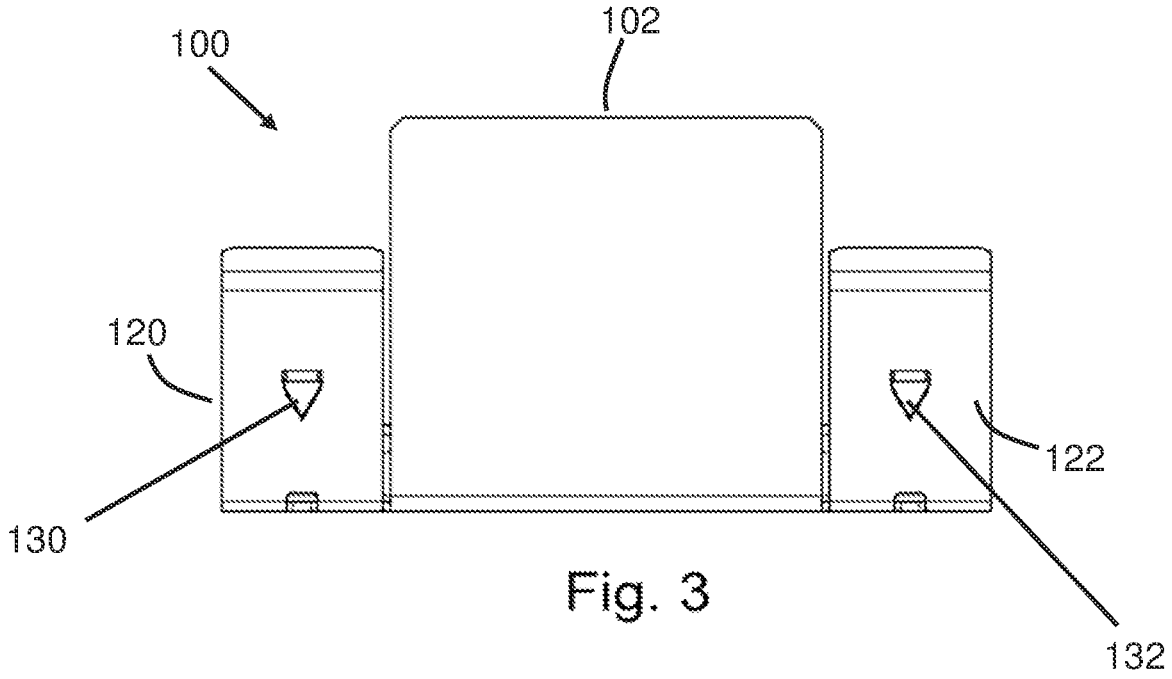
FIG. 3 is a rear view of the bracket for fastening the roof cover, according to one embodiment.
Figure 4:
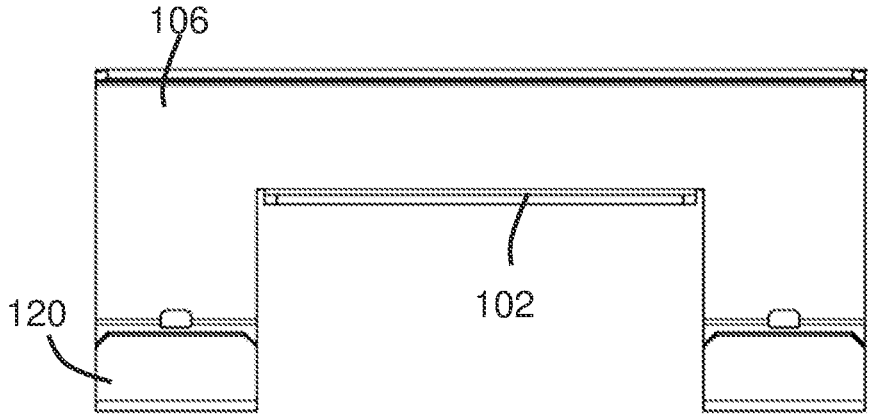
FIG. 4 is a top view of the bracket for fastening the roof cover, according to one embodiment.
Figure 5:
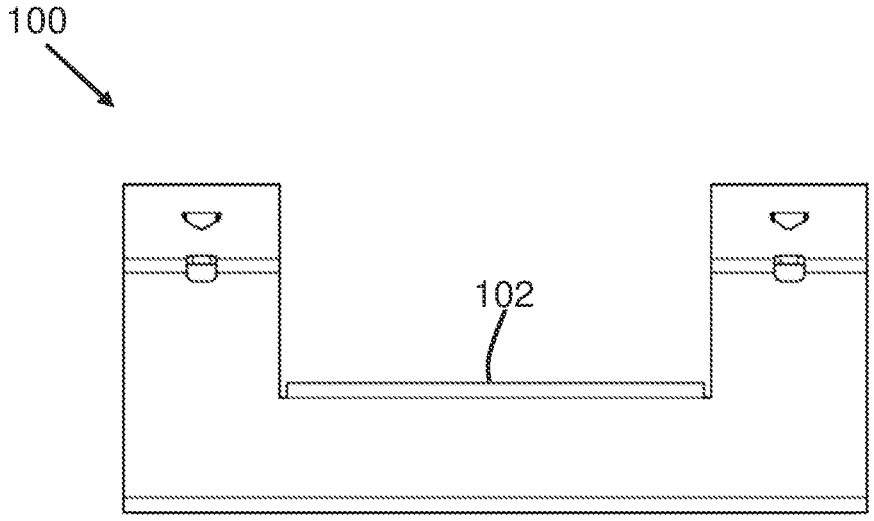
FIG. 5 is bottom view of the bracket for fastening the roof cover, according to one embodiment.
Figure 6:
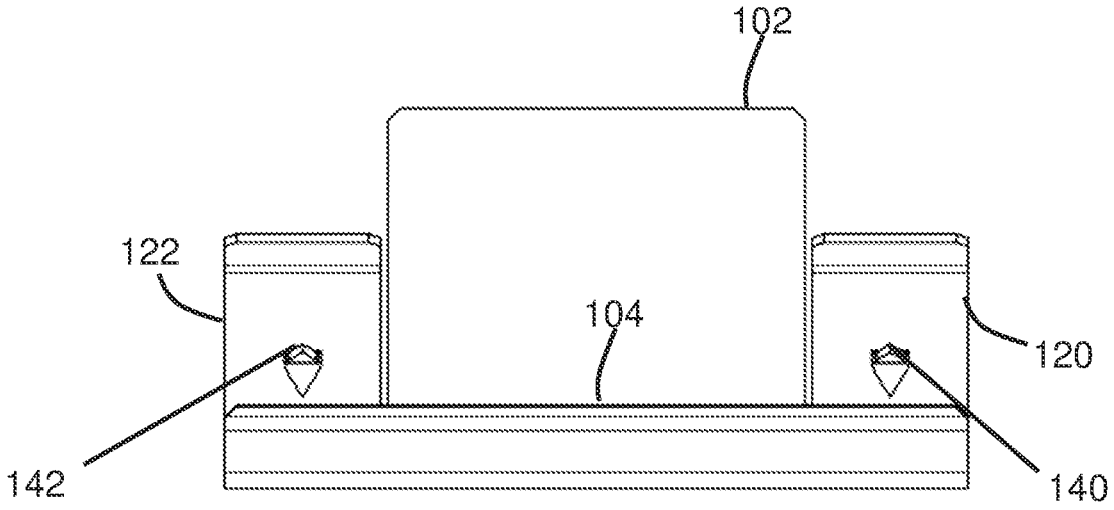
FIG. 6 is a front view of the bracket for fastening the roof cover, according to one embodiment.

The following detailed description refers to the accompanying drawings. Wherever possible, the same reference numbers are used in the drawings and the following description to refer to the same or similar elements. While embodiments of the claimed subject matter may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing an economic, user-friendly, and effective way of temporarily protecting a damaged roof, and the contents of the structure, from further damage. The claimed subject matter is further easy to learn for workers and timesaving to implement. The claimed subject matter further improves over the prior art by properly fitting the membrane to the roof size and shape and properly fastening the ends or the perimeter of the membrane to the roof. Proper fitting of the membrane to the size and shape of the roof results in a membrane that cannot be removed by intense winds or permit water to enter in between the membrane and the roof. Additionally, proper fastening of the ends, or perimeter of, the membrane, results in a membrane that is not easily removed and does not allow water penetration. Furthermore, the claimed subject matter does not introduce additional holes into the damaged roof and is a more than a temporary solution, as it can persist for periods of time longer than 90 days. Lastly, the claim subject matter provides a simple and easy to use bracket for both attaching the ends of the membrane to construction material and for attaching said construction material wrapped in the impermeable membrane to a roof without requiring any fasteners of any type, thereby resulting in less material used and fewer man hours to accomplish said task.

The accompanying drawings, which are incorporated in and constitute a part of this disclosure, illustrate various example embodiments. The claimed system and method for temporary protection of a damaged roof will now be described with respect to FIGS. 1 through 8, which depict a bracket 100 for fastening a roof cover to a roof, according to one embodiment. FIGS. 1 through 8 show that the bracket 100 comprises a metal bracket that may be formed from a single flat metal plate using metal stamping. That is, the bracket 100 comprises one, single, integrated piece of flat metal formed into a bracket.

Metal stamping (also known as pressing) is the process of placing flat sheet metal in either blank or coil form into a stamping press where a tool and die surface forms the metal into a net shape. Stamping includes a variety of sheet-metal forming manufacturing processes, such as punching using a machine press or stamping press, blanking, embossing, bending, flanging, and coining. This could be a single stage operation where every stroke of the press produces the desired form on the sheet metal part or could occur through a series of stages. Progressive dies are commonly fed from a coil of steel, coil reel for unwinding of coil to a straightener to level the coil and then into a feeder which advances the material into the press and die at a predetermined feed length. Stamping is usually done on cold metal sheet.

FIGS. 1 through 8 show that the bracket 100 comprises a central planar element 102 that extends vertically upwards from a horizontal base planar element 106, such that the central planar element 102 is perpendicular to the horizontal base planar element 106. Note that the central planar element has a smaller width than the width of the base planar element 106 and the central planar element is stated within the width of the base planar element 106. The central planar element 102 has a distal side where the arms 120, 122 are located and a proximal side where the lip 104 is located. The central planar element 102 further comprises a substantially square shape. The horizontal planar element further comprises a planar element with a substantially U-shaped footprint, as shown in top view of FIG. 4.

Figure 13:
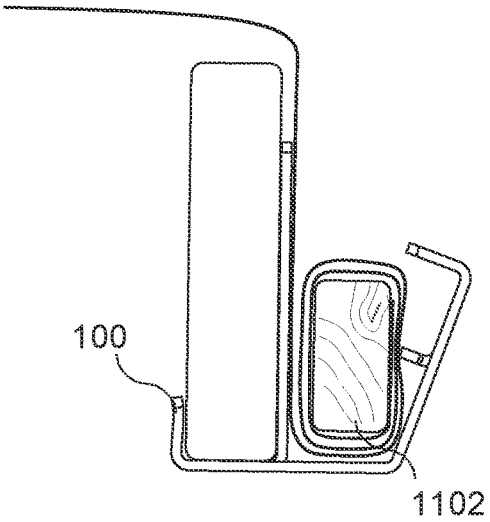
FIG. 13 is an illustration of a side view of the bracket used to attach the construction material and the impermeable membrane to the damaged roof, as the proposed system and method for temporary protection of a damaged roof is applied, according to one embodiment.
Figure 14:
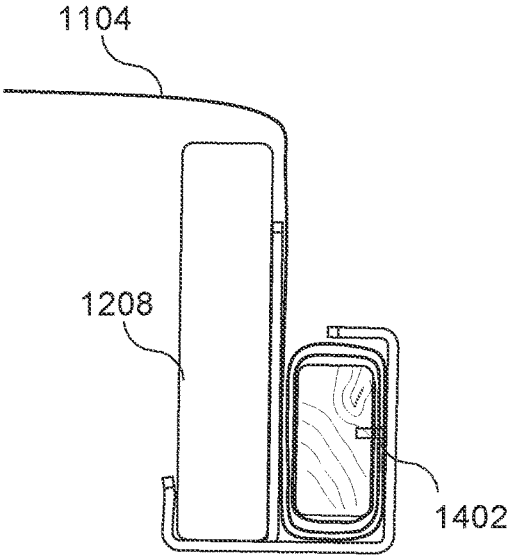
FIG. 14 is an illustration of a side view of the bracket used to attach the construction material and the impermeable membrane to the damaged roof, shown in engaged orientation, as the proposed system and method for temporary protection of a damaged roof is applied, according to one embodiment.

On the proximal side of the central planar element 102 is a lip 104 that extends vertically upwards from the horizontal base planar element 106, such that the lip 104 is perpendicular to the horizontal base planar element 106 and the lip is parallel to the central planar element 102. Note that the lip 104 has a height smaller than the height of the central planar element 102. Note also that the lip 104 may include a slight concave shape, which aids in applying pressure to the material placed within the gap 111, which is explained in greater detail below. The side of the lip 104 that faces outwards away from the device 100 is concave in the sense that is curves inwards and is hollowed out. The side of the lip 104 that faces inwards towards gap 111 is convex in the sense that it curves outwards. The portion of lip 104 that curves outwards towards gap 111 presents a protruding surface (i.e., the inside-facing surface of lip 104) that applies pressure to the material placed within the gap, such as the fascia 1208, as shown in FIGS. 13-14.

On the distal side of the central planar element 102 are a pair of arms 120, 122. Each arm comprises extends substantially vertically upwards from the horizontal base planar element 106, such that each arm is substantially perpendicular to the horizontal base planar element 106 and each arm is substantially parallel to the central planar element 102. In another embodiment, each arm extends upwards and deviates about 25 degrees from the vertical or 115 degrees from the horizontal base planar element 106. Note that as shown in FIGS. 3-6, the arms 120, 122 are located on the sides of the central planar element 102, such that when viewed form the top (see FIG. 4), the plane of the arms do not overlap with the plane of the element 102. The same applies to the catching tabs.

At the top of each arm is a catching tab, which is a short flat planar element that extends inwards (in the proximal direction) such that each catching tab is perpendicular to the corresponding arm. Arm 120 includes a catching tab 120*a* that extends inwards such that catching tab 120*a* is perpendicular to the arm 120. Arm 122 includes a catching tab 122*a* that extends inwards such that catching tab 122*a* is perpendicular to the arm 122.

Figure 7:
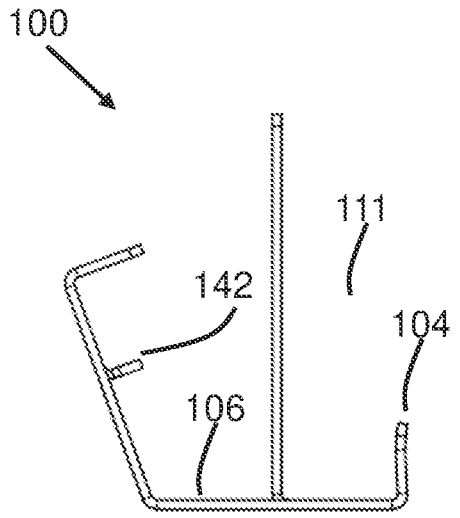
FIG. 7 is a left view of the bracket for fastening the roof cover, according to one embodiment.
Figure 8:
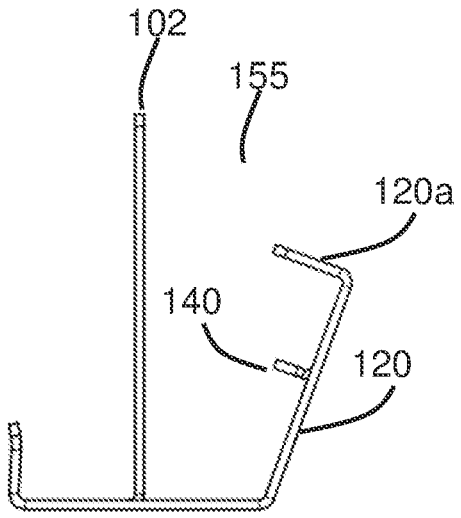
FIG. 8 is a right view of the bracket for fastening the roof cover, according to one embodiment.

FIGS. 7 and 8 show that the bracket 100 includes a gap 155 that exists, and is defined, between the central planar element 102 and the arms 122, 122. The gap 155 is configured in size and shape to accept a piece of construction material that has been wrapped one or multiple times in a roof cover membrane, as explained in greater detail below. The gap 155 is configured to securely and removably attach to construction material that has been wrapped one or multiple times in a roof cover membrane. The gap 155 is configured to accept, and create a friction fit with, construction material that has been wrapped one or multiple times in a roof cover membrane. FIGS. 7 and 8 also show that the bracket 100 includes a gap 111 that exists, and is defined, between the central planar element 102 and the lip 104. The gap 111 is configured in size and shape to accept a piece of fascia of the structure being covered, as explained in greater detail below. The gap 111 is configured to securely and removably attach to the fascia of the structure. The gap 111 is configured to accept, and create a friction fit with, a piece of fascia of the structure being covered.

On each arm is a pointy protrusion, which is a flat planar element with a point that extends inwards (in the proximal direction) such that each pointy protrusion is perpendicular to the corresponding arm. Arm 120 includes a pointy protrusion 140 that extends inwards such that pointy protrusion 140 is perpendicular to the arm 120. Arm 122 includes a pointy protrusion 142 that extends inwards such that pointy protrusion 142 is perpendicular to the arm 122. Each pointy protrusion points inwards towards the gap 155 and aids in attaching the bracket 100 to a piece of construction material that has been wrapped one or multiple times in a roof cover membrane, as explained in greater detail below. Each pointy protrusion is configured to pierce and couple to construction material that has been wrapped one or multiple times in a roof cover membrane.

On each arm is an orifice cause by the making of the pointy protrusion, since each pointy protrusion is a piece of flat metal that has been stamped out of the corresponding arm. Orifice 120 is made from the making of pointy protrusion 140 in the arm 120. Arm 122 includes orifice 132 made from the making of pointy protrusion 142. Each orifice takes the shape of the pointy protrusion which may be a triangular shape.

The pair of arms 120, 122 are configured to rotate about the vertex where the pair of arms 120, 122 meet the horizontal base planar element 106 when enough force or pressure is place against the pair of arms, such as a hammer blow. This is shown in FIG. 14 below. When the arms are moved in such a manner, they no longer deviate about 25 degrees from the vertical or 115 degrees from the horizontal base planar element 106. When the arms are moved in such a manner, they deviate about 10 degrees from the vertical or 80 degrees from the horizontal base planar element 106.

Figure 9:
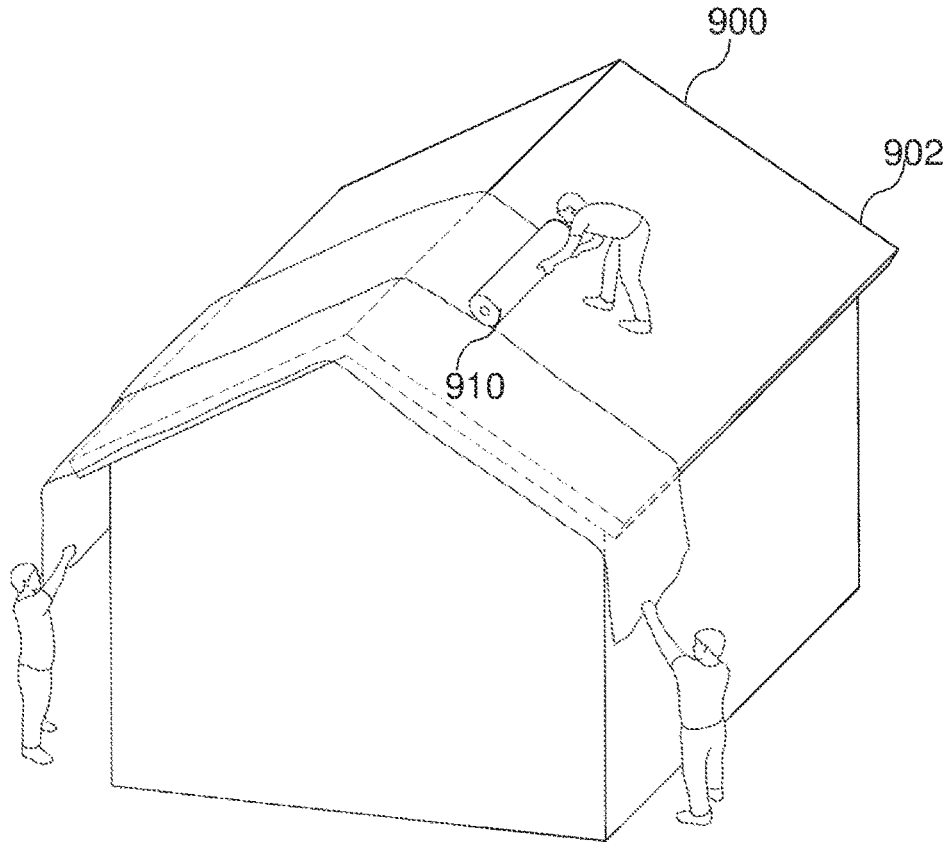
FIG. 9 is an illustration of a perspective view of a residential structure with a damaged roof, as the proposed system and method for temporary protection of a damaged roof is applied, according to one embodiment.

FIG. 9 is an illustration of a perspective view of a residential structure 900 with a damaged roof 902, as the proposed system and method for temporary protection of a damaged roof is applied, according to one embodiment. The proposed system utilizes a water impermeable membrane that may, optionally, shrink when heat is applied. Namely, when heat is applied to the water impermeable membrane, the material shrinks tightly over whatever it is covering. Further, when heat is applied to the water impermeable membrane, the membrane may become partially liquid or tacky and may meld with a membrane of the same type. That is, when two pieces of said membrane are placed adjacent to one another and heat is applied, the two pieces of the membrane may meld together and become one integrated portion of water impermeable membrane. The water impermeable membrane may be used in a variety of thicknesses, clarities, strengths and shrink ratios. The water impermeable membrane may comprise polyolefin and may be a material made up of polymer plastic film. Polyolefin is a type of polymer produced from a simple olefin (also called an alkene) as a monomer. Other examples of materials used for the water impermeable membrane include PVC, polyethylene, polypropylene, EP/EVA/copolyester/EVA/EP (where EP is ethylene-propylene and EVA is ethylene-vinyl acetate copolymer) and other compositions.

The water impermeable membrane may be provided in rolls 910 of a certain width. In one embodiment, each roll 910 of the water impermeable membrane comprises a width of about 24 to 42 inches, with each roll provided from about 40 feet to about 120 feet of length of the water impermeable membrane. FIG. 9 shows that several rolls 910 of the impermeable membrane have been placed on top of the damaged roof 902 of the residential structure 900. Each roll 910 is unrolled on top of the damaged roof 902 in the same direction and the sides of each unrolled strip of impermeable membrane are placed adjacent to another unrolled strip of impermeable membrane, such that the sides of each unrolled strip are coupled with the sides of the unrolled strips adjacent, as described more fully below.

In one alternative embodiment, strips, or portions of, the rolls 910 are cut from the roll before they are placed on top of the damaged roof 902 of the residential structure 900. In this embodiment, a length of impermeable membrane is cut from the roll, and subsequently placed on top of the damaged roof 902 of the residential structure 900. In this embodiment, workers measure the length of impermeable membrane needed for the roof, and subsequently, said measured length of impermeable membrane is cut from the roll, and then placed on top of the damaged roof 902 of the residential structure 900.

Figure 10:
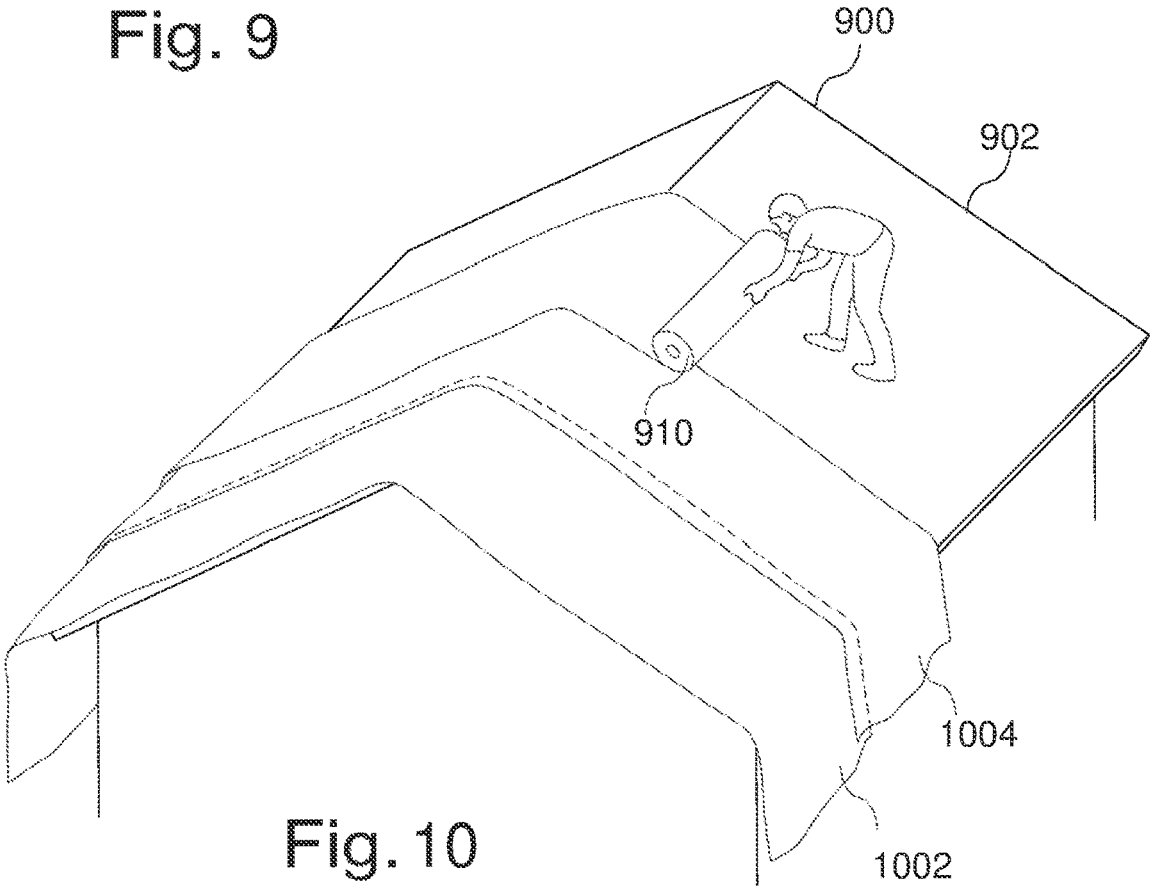
FIG. 10 is an illustration of a perspective view of the residential structure with a damaged roof, as the proposed system and method for temporary protection of a damaged roof is further applied, according to one embodiment.

FIG. 10 is an illustration of a perspective view of the residential structure 900 with a damaged roof 902, as the proposed system and method for temporary protection of a damaged roof is further applied, according to one embodiment. FIG. 10 shows multiple rolls 910 of the impermeable membrane have been placed on top of the damaged roof 902 of the residential structure 900 in order to protect said roof, and the contents of the residential structure 900, from further damage or decay from precipitation, wind, etc. FIG. 10 shows that each roll 910 is unrolled, either fully or partially, on top of the damaged roof 902 in the same direction. FIG. 10 also shows that the sides of each unrolled strip 1002 of impermeable membrane are placed adjacent to another unrolled strip 1004 of impermeable membrane. More specifically, FIG. 10 shows that the sides of each unrolled strip 1002 of impermeable membrane are placed so as to overlap (by about 3 to 8 inches) with the sides of the adjacent unrolled strip 1004 of impermeable membrane. In one embodiment, each unrolled strip 1002 of impermeable membrane are placed so as to overlap with the sides of the adjacent unrolled strip 1004 of impermeable membrane by exactly 3 inches. Subsequently, the sides of each unrolled strip are coupled with the sides of the unrolled strips adjacent, as described more fully below. Again, in one alternative embodiment, strips, or portions of, the rolls 910 are cut from the roll before they are placed on top of the damaged roof 902 of the residential structure 900.

Figure 11:
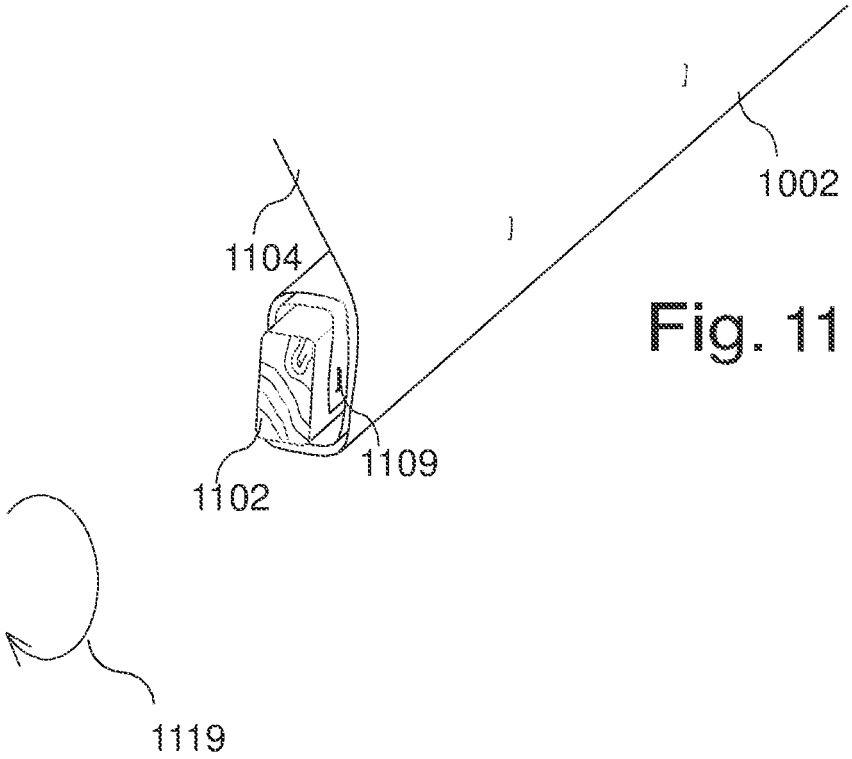
FIG. 11 is an illustration showing construction material in the process of being wrapped in the impermeable membrane, as the proposed system and method for temporary protection of a damaged roof is applied, according to one embodiment.

FIG. 11 is an illustration showing construction material 1102 in the process of being wrapped in the impermeable membrane 1104, as the proposed system and method for temporary protection of a damaged roof is applied, according to an example embodiment. In FIG. 11, the construction material 1102 is a piece of lumber, which is a type of wood that has been processed into beams and planks. A plank, i.e., a wood plank or plank of wood, is timber that is flat, elongated, and rectangular with parallel faces that are higher and longer than wide. Planks are usually more than 1½ in (38 mm) thick and are generally wider than 2½ in (64 mm). Planks can be any length and are generally a minimum of 2 in (51 mm) deep by 8 in (200 mm) wide, but planks that are 2 in (51 mm) by 10 in (250 mm) and 2 in (51 mm) by 12 in (300 mm) are more common. In one embodiment, the construction material 1102 is a wood plank that measures 2 in×4 in, 2 in×6 in, 2 in×8 in, or 2 in×12 in. In one embodiment, the construction material 302 is a wood plank that measures 1'×2'×8'.

In other embodiments, the construction material 1102 may be other items, such as portions of metal siding, portions of roof tile, etc. FIG. 11 shows the roll 910 of impermeable membrane has been unrolled to such a length that the end of the unrolled strip 1002 overhangs the eaves of the damaged roof 902 of the residential structure. FIG. 11 shows that the end of the unrolled strip 1002 (which was rolled around the construction material 1102) has been attached to the construction material 1102 via one or more fasteners 1109, which is a staple. In one embodiment, T50 ⅜' galvanized steel staples are placed 4 inches apart on the end of the unrolled strip 1002. In another embodiment, exactly 24 staples are placed on the end of the unrolled strip 1002 per instance (or plank) of construction material 1102, so as to attach the unrolled strip to the construction material. Other types of fasteners may be used to attach the construction material 1102 to the end of the unrolled strip 1002, such as nails, clips, screws, etc. Also, adhesive may be used to attach the construction material 1102 to the end of the unrolled strip 1002. FIG. 11 shows that the construction material 1102 has been wrapped in the end of the unrolled strip 1002 in a clockwise 1119 direction so that the open end of the roll faces downwards.

In an alternative embodiment, the construction material 1102 is a flexible piece of plastic strip that is available in a coiled form in 50-foot coils. The plastic, which may be regrind plastic, is uncoiled for use as the construction material for attaching to the roof. The plastic strip may be a flexible, elongated band of material. The plastic strip is wrapped in the end of the unrolled strip 1002 as described above, and the unrolled strip is attached to the plastic strip as described above. Said plastic strip is smaller than wood planks, easier to store, flexible for use in different shapes and allows work crews to work more efficiently. In one alternative embodiment, the plastic strip is not wrapped in the end of the unrolled strip 1002, as described above, rather, the outward edge of the end of the unrolled strip 1002 is attached to the plastic strip either using adhesive tape, adhesive or using a fastener 1109, as described above.

Figure 12:
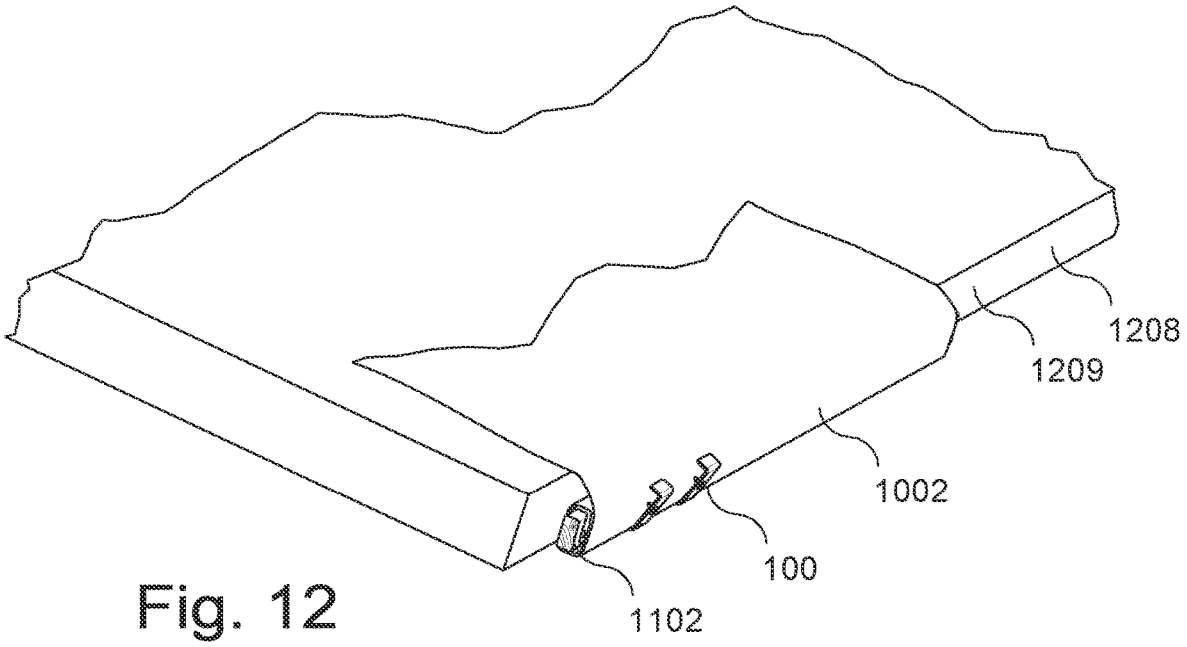
FIG. 12 is an illustration showing construction material completely wrapped in the impermeable membrane and attached to the damaged roof, as the proposed system and method for temporary protection of a damaged roof is applied, according to one embodiment.

FIG. 12 is an illustration showing construction material 1102 completely wrapped in the impermeable membrane 1104 and attached to the damaged roof 902, as the proposed system and method for temporary protection of a damaged roof is applied, according to an example embodiment. FIG. 12 shows the roll 910 of impermeable membrane had been unrolled to such a length that the end of the unrolled strip 1002 overhangs the eaves 1209 of the damaged roof 902, so as to be applied to the construction material 1102. FIG. 12 shows that the construction material 1102 has been wrapped in the end of the unrolled strip 1002, which overhangs the eaves 1209 of the damaged roof 902. Note that the construction material 1102 is attached to the vertical, outward-facing fascia 1208 of the eaves of the roof using the bracket 100. In one embodiment, each instance of the construction material 1102 is spaced 4 inches apart from the next instance of the construction material on the fascia 1208 of the eaves of the roof, around the entire perimeter of the roof. Through testing, the applicant discovered that less than 4 inches would result in a roof not being properly vented and more than 4 inches would not be secure (waterproof) enough.

In an alternative embodiment where the construction material 1102 is a flexible piece of plastic strip, the plastic is uncoiled for use as the construction material for attaching to the roof, and the plastic strip is attached to the vertical, outward-facing fascia 1208 of the eaves of the roof as described above.

FIG. 12 shows the construction material 1102 is attached to the vertical, outward-facing fascia 1208 of the eaves of the roof using the bracket 100. In another alternative embodiment, the construction material 1102 may be attached to the top of the roof (see FIG. 1), the downward facing surface under the eaves of the roof, or the vertical wall supporting the roof. In these alternative embodiments, the construction material 1102 may be attached using fasteners (or their equivalent, as described below), adhesive tape or simply adhesive.

FIG. 13 is an illustration of a side view of the bracket 100 while FIG. 14 shows the bracket in an engaged orientation. FIGS. 13-14 show a cross-sectional view of construction material 1102 completely wrapped in the impermeable membrane 1104 and attached to the fascia 1208 of the damaged roof 902, as the proposed system and method for temporary protection of a damaged roof is applied, according to an example embodiment. FIG. shows that the construction material 1102 has been wrapped in the end of the unrolled strip 1102, which overhangs the eaves of the damaged roof 902. The construction material 1102 may be wrapped such that the end of the unrolled strip 1104 completely surrounds the construction material 1 time, 2 times, or 3-4 times. I.e., in one embodiment, construction material 1102 is wrapped 1 time, 2 times, or 3-4 times in the end of the unrolled strip. In another embodiment, the construction material 1102 may be wrapped such that the end of the unrolled strip 1104 is wrapped one half turn around the construction material (i.e., it surrounds 180 degrees of the outside perimeter of the cross section of the construction material).

FIG. 13 shows that the construction material 1102 wrapped in the membrane 1104 has been placed in the gap 155 and the fascia 1208 has been inserted into the gap 111 of the bracket 100. The pair of arms 120, 122 of the bracket are configured to rotate about the vertex where the pair of arms 120, 122 meet the horizontal base planar element 106 when enough force or pressure is place against the pair of arms, such as a hammer blow.

FIG. 14 shows that when the arms are moved in such a manner, they no longer deviate about 25 degrees from the vertical or 115 degrees from the horizontal base planar element 106. When the arms are moved in such a manner, FIG. 14 shows that they deviate about 10 degrees from the vertical or 80 degrees from the horizontal base planar element 106. FIG. 14 shows that after the arms are moved, the pointy protrusion 140 has pierced and coupled to the construction material 1102 wrapped in the membrane 1104. This secures the construction material 1102 wrapped in the membrane 1104 within the gap 155. FIG. 14 shows that the end of the unrolled strip 1104 (after wrapping the construction material 1102) has been attached to the construction material 1102 via a fastener 140, which is a pointy protrusion. FIG. 14 further shows that the bracket 100 has been attached to the fascia 1208 of the roof via a fiction fit with the gap 111 of the bracket 100.

In one embodiment, the method or process of attaching the ends of the unrolled strip 1004 to the eaves of the damaged roof 902 occurs as follows. A first unrolled strip of the impermeable membrane is draped over the roof 902, wherein the end of the strip overhangs the eaves of the roof. Then, a wood plank is placed horizontally under the end of the strip that overhangs the eaves of the roof, such that the wood plank is placed below the eaves of the roof. The wood plank is placed far enough below the eaves of the roof such that when the wood plank is rolled up in the end of the strip (described below), the wood plank is at the height of the fascia of the eaves of the roof. Next, the left and right sides of the strip are cut vertically such that the strip is coextensive with a length of the wood plank. The end of the strip is also cut horizontally below the wood plank. That is, assuming the wood plank is placed horizontally so that it is parallel with the fascia of the eaves of the roof, a vertical cut is placed in the end of the strip on the left of the wood plank, a vertical cut in placed in the end of the strip on the right of the wood plank, and a horizontal cut is placed in the end of the strip below the wood plank.

In an alternative embodiment where the construction material 1102 is a flexible piece of plastic strip (wherein the plastic is uncoiled for use as the construction material for attaching to the roof, and the plastic strip is attached to the vertical, outward-facing fascia 1208 of the eaves of the roof), the plastic strip is placed horizontally under the end of the membrane strip that overhangs the eaves of the roof, such that the plastic strip is placed below the eaves of the roof. The plastic strip is placed far enough below the eaves of the roof such that when the plastic strip is rolled up in the end of the membrane strip (described below), the plastic strip is at the height of the fascia of the eaves of the roof. The left and right sides of the membrane strip are not necessarily cut vertically. The end of the membrane strip may be cut horizontally below the plastic strip. That is, assuming the plastic strip is placed horizontally so that it is parallel with the eaves of the roof, a horizontal cut is placed in the end of the membrane strip below the plastic strip. There is no need to cut the membrane strip vertically because the plastic strip may be extended beyond the left and right edges of the membrane strip.

In another alternative embodiment where the construction material 1102 is a flexible piece of plastic strip (wherein the plastic is uncoiled for use as the construction material for attaching to the roof, and the plastic strip is attached to the vertical, outward-facing fascia 1208 of the structure), the plastic strip is placed horizontally under the end of the membrane strip. The left and right sides of the membrane strip are not necessarily cut vertically. The end of the membrane strip may be cut horizontally below the plastic strip. That is, assuming the plastic strip is placed horizontally so that it is parallel with the end of the membrane strip, a horizontal cut may or may not be placed in the end of the membrane strip below the plastic strip. There is no need to cut the membrane strip vertically because the plastic strip may be extended beyond the left and right edges of the membrane strip. Then, the end of the membrane strip may be attached to the plastic strip using a fastener, adhesive tape or simply adhesive. Subsequently, the construction material 1102 wrapped in membrane is attached to the bracket 100 and the bracket is attached to fascia 408 of the structure.

Returning to the wood plank embodiment, the wood plank may be fastened to the end of the strip using a plurality of staples. Next, the wood plank is rolled one half turn (180-degree turn), one full turn (360 degrees), two full turns (720 degrees), or three full turns in the end of the strip, such that the wood plank is at a height of the fascia of the eaves of the roof. Then, the wood plank that was rolled in the end of the strip is attached to bracket 100 (as shown in FIG. 13) and the bracket is attached the fascia of the eaves of the roof (as shown in FIG. 14). Further, each strip of the impermeable membrane that has been draped over the roof is placed such that it overlaps at least three inches with each adjacent strip of the impermeable membrane that has been draped over the roof. The steps above are repeated until the entire roof is covered in the impermeable membrane. Finally, heat may be applied using a heat source to a portion of each strip that overlaps an adjacent strip, so as to meld the portion of each strip with the adjacent strip (as described more fully below). Also, heat may be applied using a heat source to all or a portion of the impermeable membrane on the roof, so as to shrink the membrane for aerodynamic purposes (to reduce or eliminate the membrane blowing off in a wind) and for hydrodynamic purposes to aid in water running or falling off the roof.

Figure 15:
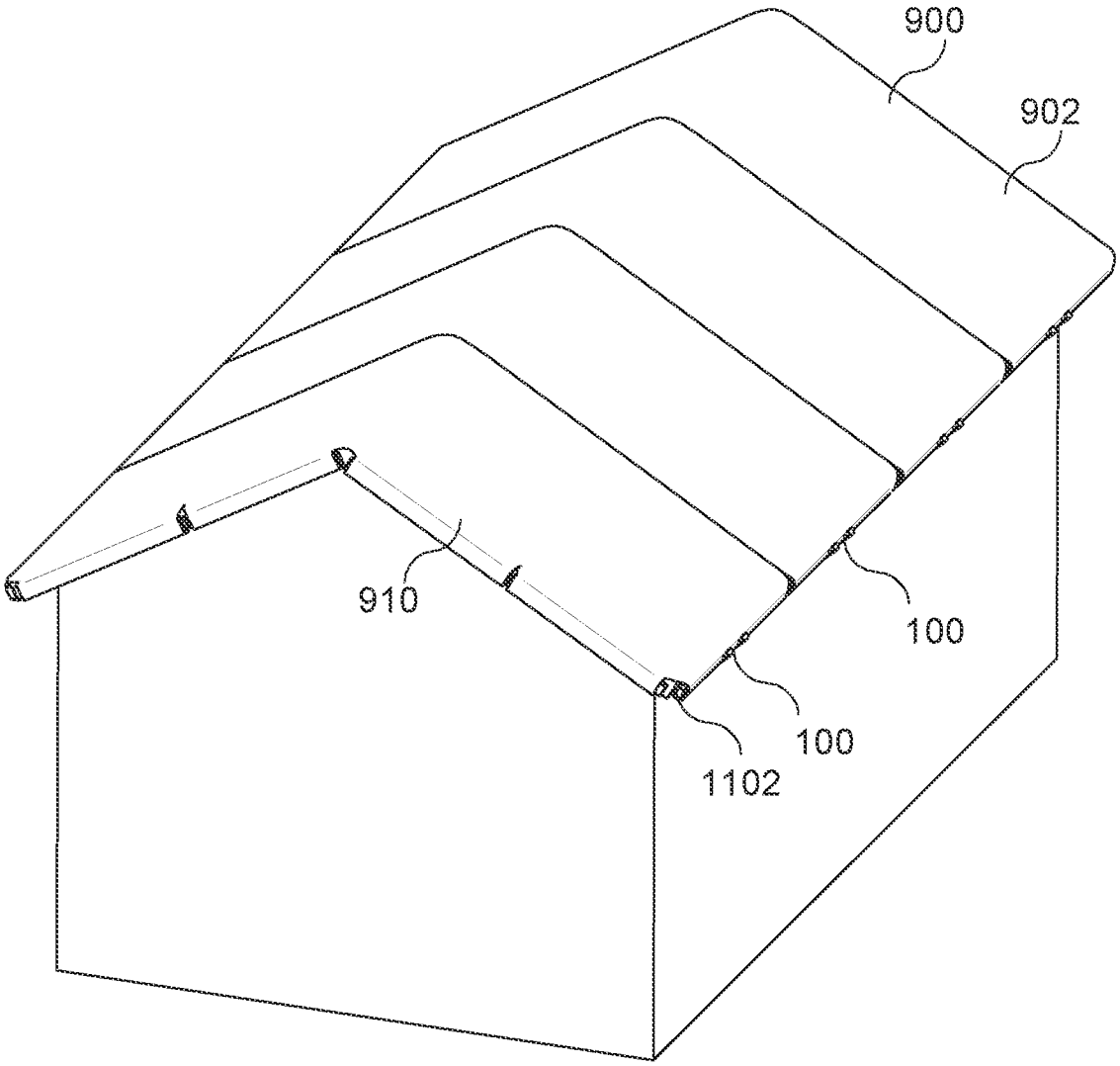
FIG. 15 is an illustration of a perspective view of the residential structure with a damaged roof, showing the proposed system and method for temporary protection of a damaged roof completely applied, according to one embodiment.

FIG. 15 is an illustration of a perspective view of the residential structure 900 with a damaged roof 902, showing the proposed system and method for temporary protection of a damaged roof completely applied, according to one embodiment. FIG. 15 shows that multiple rolls 910 of the impermeable membrane have been draped on top of the damaged roof 902 of the residential structure 900 in the same direction, such that the entire roof is covered in the impermeable membrane. FIG. 15 shows that the construction material 1102 on the eaves of the roof has been wrapped in the end of the unrolled strip in a clockwise direction so that the open end of the roll faces downwards. This reduces or eliminates the pooling of water in the open end of the roll. FIG. 15 shows that the construction material 1102 has been attached to the roof using a plurality of brackets 100.

Said process described above for waterproofing a structure can also be used to provide wall insulation for a wall of a structure, to provide dust barriers for a structure, to provide waterproofing of a structure during construction, to provide waterproofing of a structure under construction that is lacking exterior windows, doors, and walls, and for containment of the interior of buildings. Said process described above for waterproofing a structure can also be used to provide a separation in the interior of buildings or warehouses for smaller temporary rooms for security or temperature control.

Note that although FIG. 15 shows that the entire top of the roof of the structure has been completely covered by the impermeable membrane, the claimed embodiments support a process wherein only a predetermined portion, or subset, of the top of the roof of the structure has been covered by the impermeable membrane. This embodiment works in cases where only a portion of the roof has been damaged and saves the time and expense of covering the entire roof, which may not be necessary.

Embodiments may be described above with reference to functions or acts, which comprise methods. The functions/acts noted above may occur out of the order as shown or described. For example, two functions/acts shown or described in succession may in fact be executed substantially concurrently or the functions/acts may sometimes be executed in the reverse order, depending upon the functionality/acts involved. While certain embodiments have been described, other embodiments may exist. Further, the disclosed methods' functions/acts may be modified in any manner, including by reordering functions/acts and/or inserting or deleting functions/acts, without departing from the spirit of the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A bracket for fastening an impermeable membrane to a roof, the bracket comprising:

a) a horizontal planar element comprising a planar element with a substantially U-shaped footprint;

b) a central planar element extending upwards from, and being perpendicular to, the horizontal planar element, the central planar element comprising a substantially square shape;

c) a lip extending upwards from, and being perpendicular to, the horizontal planar element, the lip comprising a planar element with a height shorter than a height of the central planar element;

d) a first gap defined by the central planar element on one side and the lip on another side, the first gap configured to accept and create a friction fit with a side of a fascia of a structure;

e) a first arm and a second arm extending upwards from the horizontal planar element, each of the first and second arms comprising a planar element with a height shorter than a height of the central planar element;

f) one or more fasteners protruding from each of the first and second arms for piercing and coupling to a construction material wrapped in a membrane;

g) a second gap defined by the central planar element on one side and the first and second arms on another side, the second gap configured to accept and secure to construction material and impermeable membrane;

h) wherein the first arm includes a catching tab comprising a planar element extending from, and being perpendicular to, the first arm; and i) wherein the second arm includes a catching tab comprising a planar element extending from, and being perpendicular to, the second arm.

2. The bracket of claim 1, wherein the first arm extends upwards from the central planar element at an angle of about 115 degrees and wherein the second arm extends upwards from the central planar element at an angle of about 115 degrees.

3. The bracket of claim 2, wherein the one or more fasteners comprises a first fastener protruding from the first arm and a second fastener protruding from the second arm.

4. The bracket of claim 3, wherein each of the first and second fasteners comprising a pointy protrusion configured to pierce and couple to the impermeable membrane and construction material.

5. The bracket of claim 1, wherein the first and second arms are configured for rotating about the horizontal planar element towards the central planar element.

* * * * *